US005131598A

United States Patent [19]

Hoogeveen, Jr.

[11] Patent Number: 5,131,598

[45] Date of Patent: Jul. 21, 1992

[54] AIR BRUSH

[75] Inventor: James W. Hoogeveen, Jr., Griffin, Ind.

[73] Assignee: Koz Bros. Toys, Ltd., Elmhurst, Ill.

[21] Appl. No.: 662,758

[22] Filed: Mar. 1, 1991

[51] Int. Cl.[5] ..... B05B 3/02; B05C 17/12

[52] U.S. Cl. ..... 239/223; 239/214

[58] Field of Search ..... 239/214, 219, 222, 222.11, 239/223, 224, 120, 121, 225.1, 380, 99, 102.1, 214.23

[56] References Cited

U.S. PATENT DOCUMENTS

| | | | |
|---|---|---|---|
| 1,908,230 | 5/1933 | Fawkes | 239/222 |
| 3,421,697 | 1/1969 | Marks | 239/222 |
| 3,539,110 | 11/1970 | Kobayashi | 239/223 |
| 4,235,377 | 11/1980 | Davis et al. | 239/222 |
| 4,392,614 | 7/1983 | Groth et al. | 239/222 |

*Primary Examiner*—Andres Kashnikow

*Assistant Examiner*—Lesley D. Morris

*Attorney, Agent, or Firm*—Allegretti & Witcoff, Ltd.

[57] ABSTRACT

An air brush includes a housing having a chamber. A battery-driven fan is rotatably disposed in the chamber. The fan includes a plurality of radially extending blades. The chamber has an inlet opening and an outlet opening. A paint container is associated with the inlet opening for supplying paint to the fan. In a preferred embodiment, a guide extends from the paint container into contact with the fan blades for guiding paint to be sprayed to the extremities of the fan blades. The outlet opening is restricted by a detachable cover having a hole therethrough. The hole is of a selected predetermined size and shape to help spray a predetermined area with the air brush. The cover may be removed to permit a broader spray discharge. The chamber in the housing is provided with a drain opening. A detachable reservoir is secured to the housing below the drain opening for collecting paint discharged from the drain opening.

12 Claims, 1 Drawing Sheet

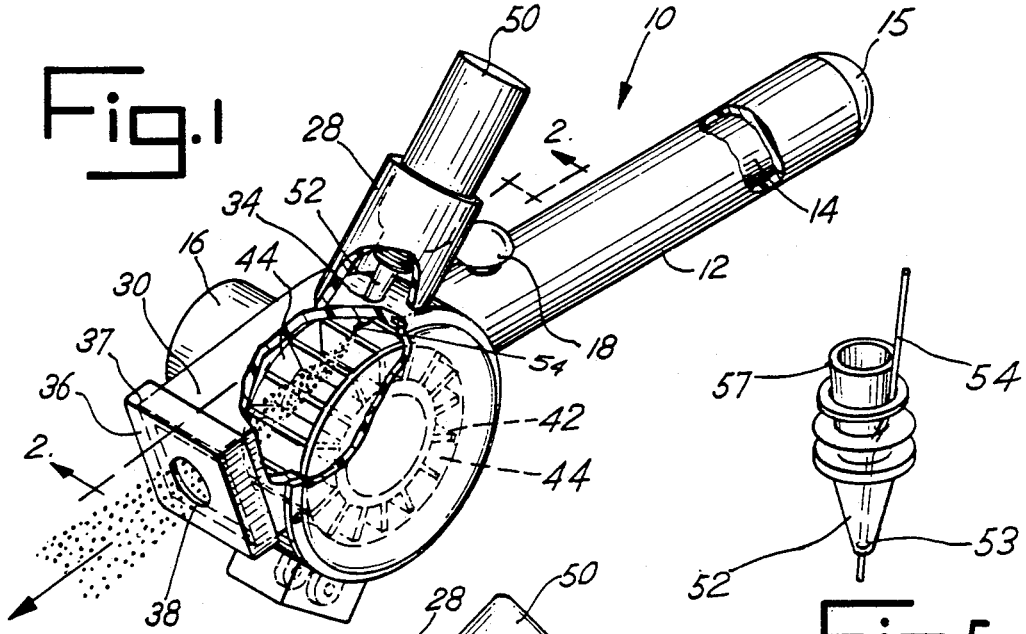
Fig.1
50
10
15
28
2
34
52
14
16
44
12
30
18
37
54
36
42
2
44
38
57
54
53
52
Fig.5
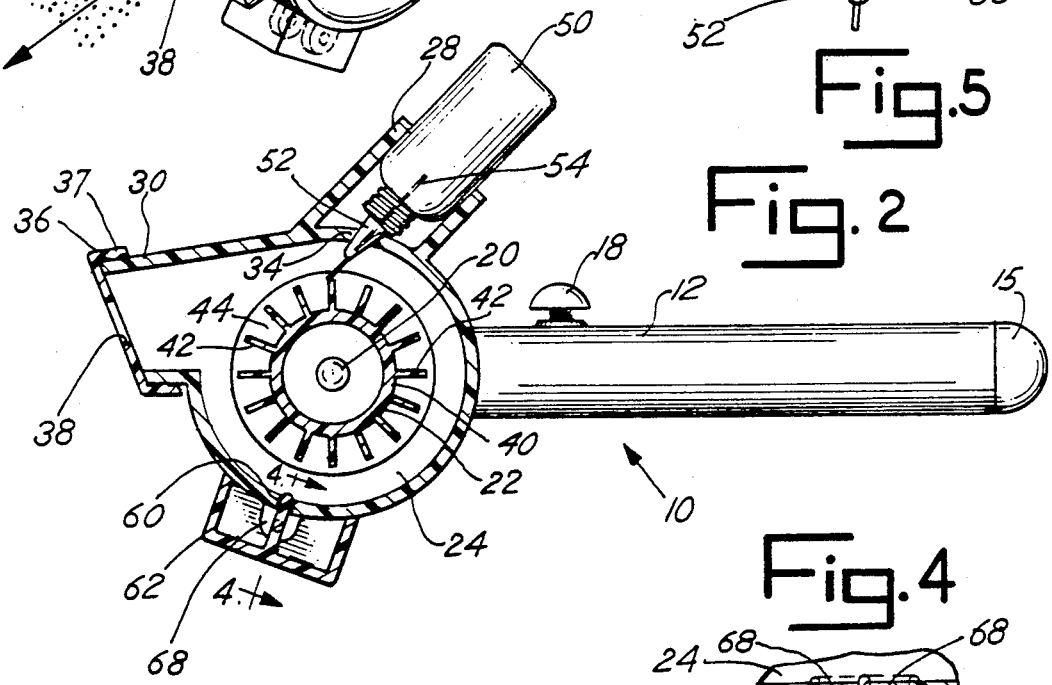
Fig. 2
28
50
52
54
37
30
36
34
20
18
44
42
12
15
42
38
40
4
22
10
60
24
62
4
68
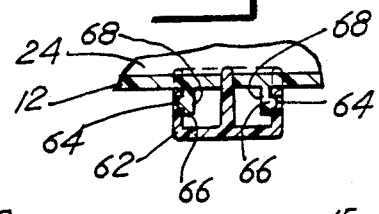
Fig.4
24
68
68
12
64
64
62
66
66
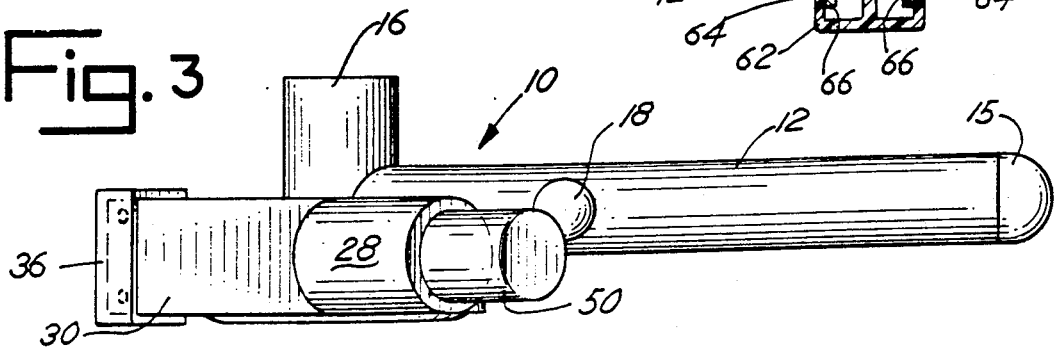
Fig. 3
16
10
18
12
15
36
28
50
30

AIR BRUSH

BACKGROUND OF THE INVENTION

This invention pertains to an air brush and, more particularly, to an air brush that is relatively simple to fabricate and operate and which dispenses paint in a uniform fashion.

There is known in the prior art an air brush based on the principle of aspiration of paint from a container and then forcing the paint through a nozzle by means of pressurized air. An example of this type device is shown in Rebold U.S. Pat. No. 4,171,097.

A compression type spray device employing a single nozzle for spraying materials that vary widely in density composition in particle size is disclosed in the Hopp U.S. Pat. No. 4,204,645. The devices shown in the prior art patents are rather bulky and cumbersome in operation.

An object of the present invention is to provide an air brush or spray device for use by hobbyists, artists or the like which is relatively simple to manufacture at low cost and is relatively easy to operate.

Another object of the present invention is to provide an improved air brush utilizing a fan for spraying the pain received through an inlet opening and discharging the same through an outlet opening to a point of use in a uniform and continuous manner.

Still another object of this invention is to provide an improved air brush utilizing a paint container having a guide extending from the opening thereof into contact with a rotating fan for vibrating the guide in use so as to better disperse paint onto the fan for discharge form the air brush onto a surface to be painted.

Yet another object of the present invention is to provide an air brush containing a self-contained power means for driving a bladed fan, which cooperates with a guide extending from a paint container for better dispersing the paint on the fan for discharge from the air brush onto a surface to be painted. These and other objects of the present invention will become more apparent hereinafter.

BRIEF DESCRIPTION OF THE DRAWINGS

There is illustrated in the attached drawing a presently preferred embodiment of the present invention wherein like numerals in the various views refer to like elements and wherein:

FIG. 1 is a perspective view with parts broken away illustrating the air brush of the present invention;

FIG. 2 is a longitudinal cross-sectional view of the air brush taken generally along the line 2—2 of FIG. 1;

FIG. 3 is a plan view of the air brush;

FIG. 4 is a detail cross-sectional view taken generally along the line 4—4 of FIG. 2 and better illustrating the paint collector reservoir; and FIG. 5 is a detailed perspective view better illustrating the retention of the guide in the dispensing spout of the container for paint.

DETAILED DESCRIPTION OF THE PRESENT INVENTION

Referring to the drawing it is seen that the air brush 10 of the present invention comprises basically a housing 12 containing therein battery power means 14 operatively connected to a motor 16 through a switch 18. The shaft 20 of the motor is directly connected to the fan 22 which is journalled within the chamber 24 of the housing 12. The housing 12 includes an inlet flange 28 and outlet flange 30. The inlet flange 28 is generally circular and encloses an inlet opening 34 from the exterior to the chamber 24 within the housing 12. The outlet flange 30 may be generally square in cross-section and is adapted to receive at its outer end a cover 36 provided with a predetermined sized opening 38 therein. The cover 36 is detachably affixed to outlet flange 30, e.g., by a friction fit between the annular flange 37 and the exterior of outlet flange 30.

The fan 22 may be of the type having a central cylindrical member 40 with a plurality of radially extending blades 42 extending therefrom. The fan 22 includes a pair of spaced apart transverse walls 44. Walls 44 are perpendicular to the axis of rotation of the fan 44. The portion 40 is adapted to be suitably secured to the shaft 20 of the electric drive motor 16, for example, by a force fit or with a set screw or like fastener.

Referring to FIGS. 1, 2, and 3 it is seen that a bottle or container 50 of paint is adapted to be received in the inlet flange 28. The bottle 50 which is similar to an eye dropper is provided with a generally conical dispensing spout or nozzle 52 that is adapted to extend through the opening 34 into the chamber 24. The end of the nozzle 52 may be positioned proximate to the tips of the blades 42 of fan 22. Preferably a guide 54 is provided through the opening in the nozzle 52 into the bottle 50 to assist in guiding the paint directly from the nozzle 52 to the extremities of the blades 42. The guide 54 engages the tips of the blades 42 and is vibrated thereby in use for better dispersion of the paint from the container 50 onto the fan 22. The guide 54 may be made from a metal tube or rod or it may be made from plastic which exhibits memory or the ability to be moved from an untensioned position to a tensioned state and then returned automatically to its untensioned position so as to maintain the desired position of the tip of the guide relative to the fan blades 42. Though a solid or hollow plastic member is preferred, a wire or plastic coated wire has been found useful.

With reference to FIGS. 2 and 4, there is provided in the bottom wall defining chamber 24 a drain opening 60. Detachably secured beneath the drain opening 60 for receiving excess paint from chamber 24 is a reservoir 62. The reservoir 62 is provided with a pair of recesses 64 which are adapted to cooperate with projections 66 on depending lugs 68 extending from housing 12. The reservoir 62 is open at the top. In use, excess paint not discharged from the opening 38 will gather in the bottom of chamber 24 and be discharged through drain opening 60 into reservoir 62. The reservoir 62 is detachably secured to the housing 12. The reservoir 62 filled with paint can be removed from housing 12. The nozzle 52 of container 50 may be removed and the paint from the reservoir 62 can be poured into the container 50 for re-use.

In FIG. 5, the manner of affixing the guide 54 within the dispensing spout 52 is shown. The guide 54 is positioned through the opening 53 in the tip of the dispensing spout or nozzle 52 a predetermined distance. The guide 54 is retained in selected position by inserting into the dispensing spout a tubular member 57 complementary in external shape to the internal shape of the inlet to the dispensing spout 52. The member 57 fits snugly within the dispensing spout 52 and thereby retains the guide 54 in selected adjusted position with a predetermined length extending from the dispensing spout 52.

It will be understood that in order to utilize the air brush, battery power means 14 are provided within the housing 12 and the cap 15 is positioned to close the end of the housing 12 and retain the battery or batteries in position within the housing 12. Preferably, the batteries may comprise two AA cells. A bottle 50 with a selected color of paint is positioned within the inlet flange 28 as indicated in FIGS. 1, 2, and 3. The guide 54 is inserted into the opening from the nozzle 52 of container 50 prior to introduction into the inlet flange 28 and the guide 54 is positioned so that it just engages the extremities of the blades 42 of the fan 22 so as to be vibrated by fan 22. The guide 54 is held in selected adjusted position in the dispensing nozzle 52 by member 57. The button or switch 18 is actuated in order to connect the battery power source 14 to the electric drive motor 16. Upon actuation of the drive motor 16, shaft 20 will be rotated in order to drive the fan 22. The rapid rotation of the fan 22 will vibrate the guide 54 and cause the paint to be dispersed onto the fan blades 42 and into the air stream for passage through the opening 38 in cover 36 and discharge onto a surface. The paint will be dispersed in a substantially uniform and continuous fashion. Cover 36 can be removed to permit a wider spray of paint form the outlet flange 30. The opening 38 may be of predetermined size and shape in order to better guide the quantity and direction of the paint borne airstream discharged from the air brush 10. The user may be provided with a set of covers 36 having openings or holes 38 of different sizes and shapes to permit different spray patterns.

It will be understood that a plurality of containers 50, each having a different color paint, may be supplied with the air brush. To utilize a different color, a container 50 is removed from the inlet flange 28 and a different container with a different color paint may be substituted.

There has been provided by the present invention an improved air brush that is simple in construction, fabrication and use.

While I have shown a presently referred embodiment of the present invention, it will be understood that it may otherwise be embodied within the scope of the appended claims.

I claim:

1. An air brush comprising a housing, self-contained power means in said housing, a fan journalled in said housing and driven by said power means, said fan being disposed in a chamber having an inlet opening and an outlet opening, paint supply means operatively associated with said inlet opening including a vibrating guide for supplying paint to said fan responsive to rotation of said fan, said fan discharging said paint in a substantially uniform and continuous fashion during rotation of said fan.

2. An air brush as in claim 1 wherein the power means includes an electric motor for driving said fan.

3. An air brush as in claim 2 including batteries operatively associated with said electric motor for driving same.

4. An air brush as in claim 3 including switch means in circuit with the batteries and the electric motor for controlling the operation of the electric motor.

5. An air brush as in claim 1 including a cover for the outlet opening affixed to the housing, said cover having an opening therethrough.

6. An air brush as in claim 1 wherein the paint supply means comprises a paint container for supplying paint through the inlet opening to the fan.

7. An air brush as in claim 6 wherein the guide extends from the paint container into engagement with the periphery of the fan for supplying paint to the periphery of the fan.

8. An air brush comprising a housing, self-contained power means in said housing, a fan journalled in said housing and driven by said power means, said fan being disposed in a chamber having an inlet opening and an outlet opening, paint supply means operatively associated with said inlet opening including a guide for supplying paint to said fan, said fan discharging said paint in a substantially uniform and continuous fashion, said paint supply means comprising a paint container for supplying paint through the inlet opening to the fan, said fan including a plurality of generally radially extending blades and the paint container includes a dispensing nozzle having an opening therein, said guide extending from the opening in the nozzle into engagement with the periphery of the fan blades for vibrating the guide to help better disperse paint from the paint container onto the fan blades for discharge from the outlet opening.

9. An air brush as in claim 1 including a means cooperating with the dispensing nozzle for fixing the guide in selected adjusted position with a predetermined length extending from the nozzle.

10. An air brush as in claim 1 including a drain opening in the housing communicating with said chamber, and a reservoir detachably secured to the housing for collecting paint discharged through the drain opening.

11. An air brush comprising a housing, self-contained power means in said housing, a fan journalled in said housing and driven by said power means, said fan being disposed in a chamber having an inlet opening and an outlet opening, paint supply means operatively associated with said inlet opening including a vibrating guide for supplying paint to said fan, said guide comprising a plastic member which exhibits memory, said fan discharging said paint in a substantially uniform and continuous fashion.

12. An air brush comprising a housing, self-contained power means in said housing, a fan journalled in said housing and driven by said power means, said fan being disposed in a chamber having an inlet opening and an outlet opening, paint supply means operatives associated with said inlet opening including a vibrating guide for supplying paint to said fan, said guide comprising a wire, said fan discharging said paint in a substantially uniform and continuous fashion.

* * * * *